United States Patent [19]

Hampton

[11] 4,190,999

[45] Mar. 4, 1980

[54] LOCATOR FOR VERTICAL REINFORCING BARS

[76] Inventor: Ralph C. Hampton, 18881 Gentian, Riverside, Calif. 92504

[21] Appl. No.: 899,829

[22] Filed: Apr. 25, 1978

[51] Int. Cl.[2] ..... E04C 5/16

[52] U.S. Cl. ..... 52/687; 52/565; 52/442

[58] Field of Search ..... 52/681, 683, 687, 712, 52/568, 562, 564, 565, 258, 379, 383, 414, 426, 428, 442

[56] References Cited

U.S. PATENT DOCUMENTS

| | | | |
|---|---|---|---|
| 1,084,389 | 1/1914 | Blackmore | 52/712 |
| 1,304,651 | 5/1919 | Bodine | 52/428 |
| 1,616,977 | 2/1927 | Koivu | 52/426 |
| 1,762,099 | 6/1930 | Phillips | 52/564 |
| 1,924,724 | 8/1933 | Olney | 52/397 |
| 2,099,951 | 11/1937 | Bitney | 52/653 |
| 2,128,497 | 8/1938 | Olsen | 52/428 |
| 3,145,505 | 8/1964 | Cornelius | 52/562 |
| 3,238,684 | 3/1966 | Wood | 52/379 |
| 3,309,828 | 3/1967 | Tribble | 52/428 |
| 4,034,529 | 7/1977 | Lampus | 52/426 |

FOREIGN PATENT DOCUMENTS

| | | | |
|---|---|---|---|
| 476568 | 8/1915 | France | 52/423 |
| 1124298 | 10/1956 | France | 52/428 |

*Primary Examiner*—James A. Leppink

*Assistant Examiner*—Henry E. Raduazo

*Attorney, Agent, or Firm*—Herbert E. Kidder

[57] ABSTRACT

A fixture for precisely locating the vertical reinforcing steel bars in a hollow block wall at the exact positions specified by the design engineer. The fixture comprises one or more steel wires forming a horizontal supporting structure that is adapted to be laid on the top surfaces of the blocks at various levels as the blocks are being laid. In the preferred form, the horizontal supporting structure is a ladder-like structure made up of two laterally spaced, parallel wires connected together at intervals by cross wires. Certain of the cross wires have circular rings formed therein or attached thereto, and all of the cross wires have downwardly projecting legs that extend down into the cavities of the hollow blocks and engage the inner surfaces thereof to locate the ladder-like structure with respect to the blocks. The rings are positioned in vertical alignment with respect to one another, and the vertical bars are lowered into the block cavities from the top of the wall, with the bar being inserted through each of the rings, in turn, at the different levels. After the steel bars have been placed, the cavities are filled with cement grout, which embeds the bars. The rings can be located at various points to locate the vertical steel bars at the exact positions specified by the design engineer, and in some cases, one set of rings may be provided to receive the stub steel bars projecting upwardly from the concrete footing, while another set of rings receives the vertical reinforcing bars.

4 Claims, 8 Drawing Figures

FIG. 1.
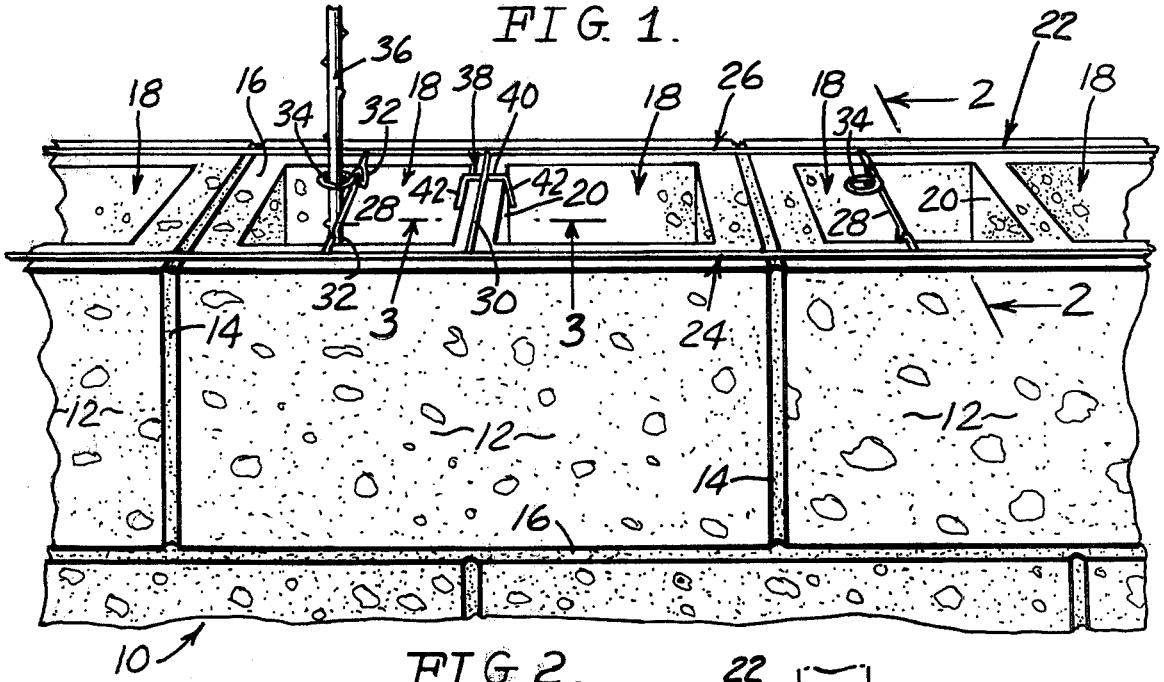
FIG. 2.
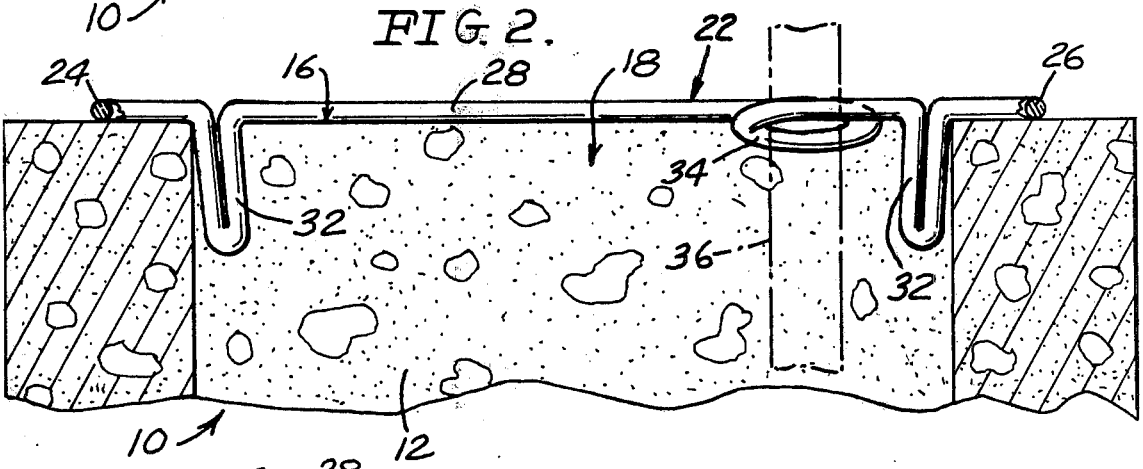
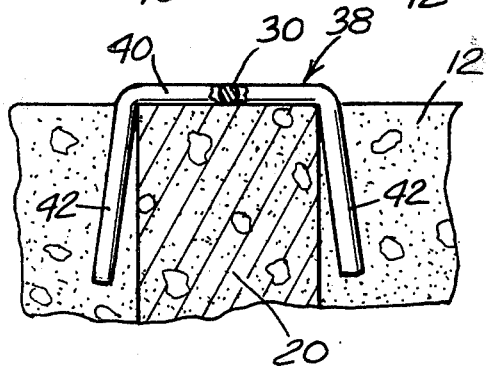
FIG. 3.
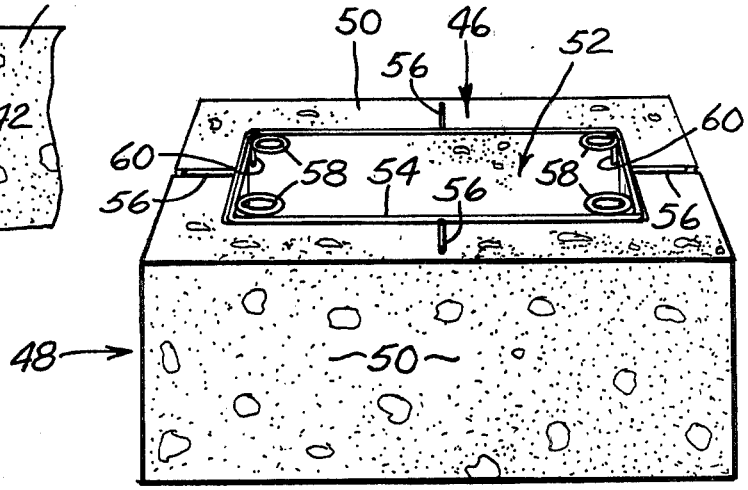
FIG. 7.

FIG. 4.
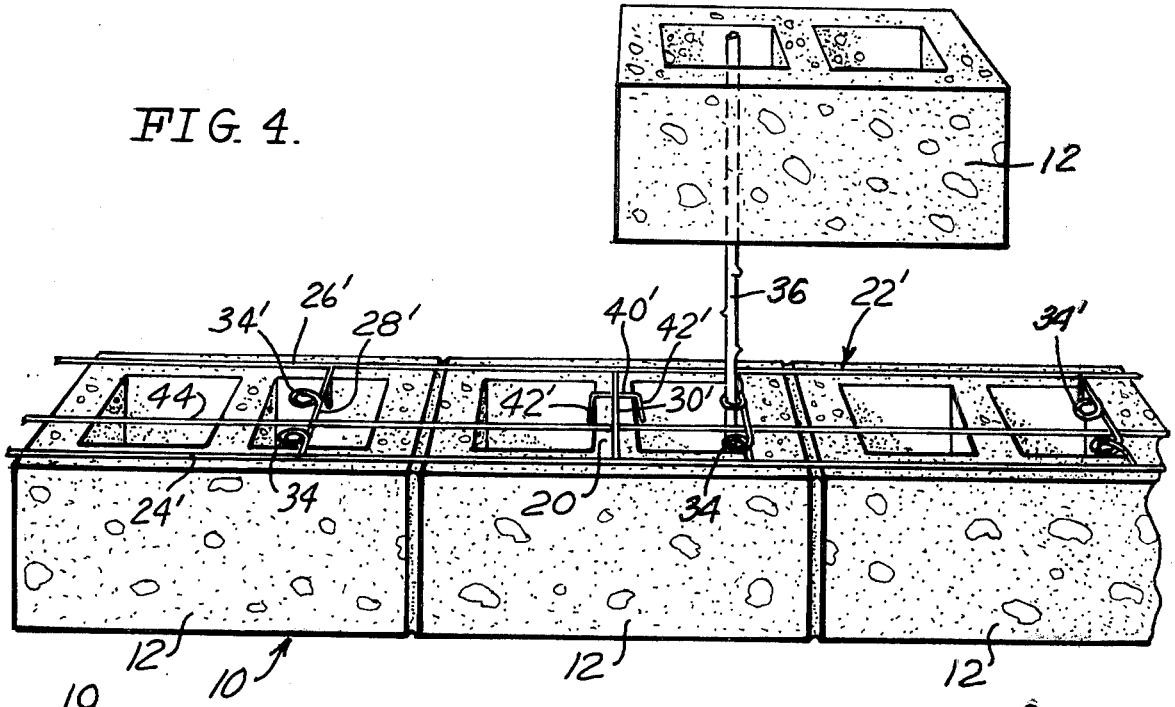
FIG. 5.
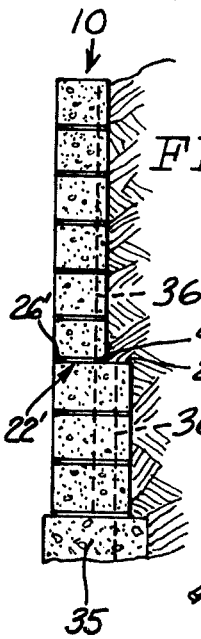
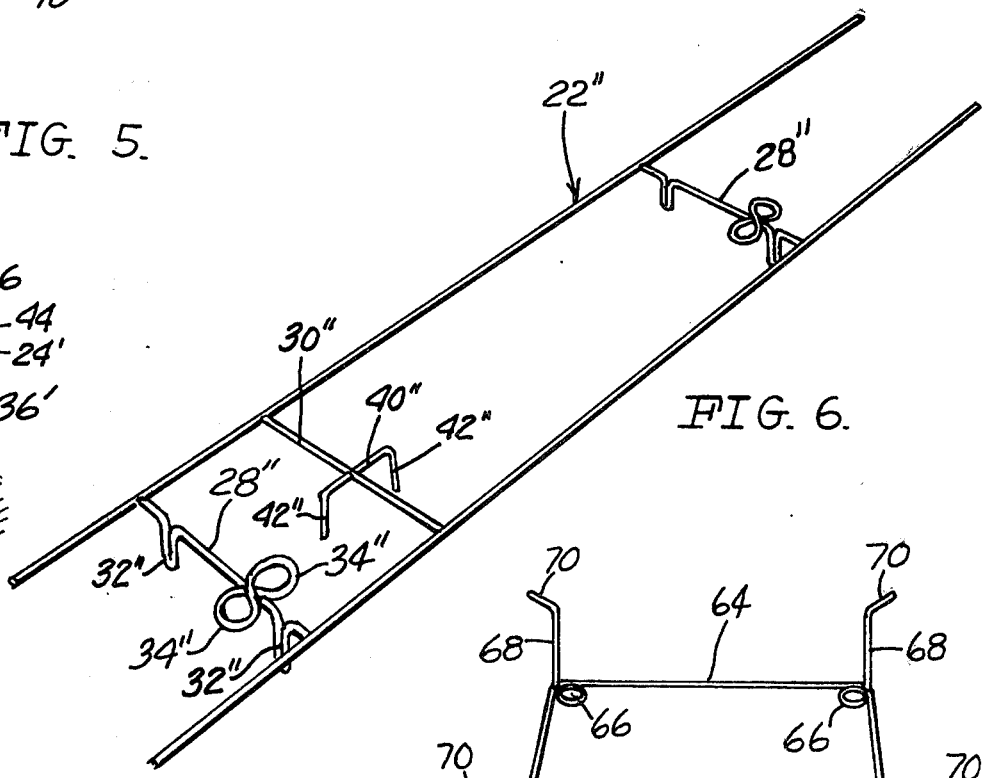
FIG. 6.
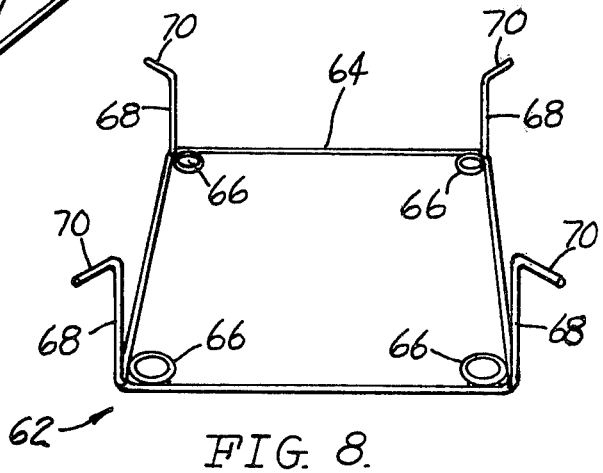
FIG. 8.

LOCATOR FOR VERTICAL REINFORCING BARS

BACKGROUND OF THE INVENTION

The present invention pertains to steel reinforcement used in concrete block construction, and more particularly to a device for positioning vertical steel reinforcement bars precisely where they are designed to be located, so that the full tensile strength of the steel bar is utilized, as intended by the engineer who designs the wall.

Concrete blocks and mortar have relatively little tensile strength, and it is therefore necessary to use steel reinforcing bars to provide the necessary tensile strength; some of the bars extending vertically through the cavities in the blocks, so as to anchor the blocks to the concrete footing; and some extending horizontally along the motar joints at various levels. The vertical bars are particularly important, as they provide most of the tensile strength to prevent the wall from failing under horizontal pressure, such as the pressure exerted by soil on one side of the wall. For most economical design, the engineer locates the bar as far as possible from the neutral axis of the wall toward the tension side of the wall, while still allowing a certain minimum amount of space between the bar and the inner surface of the block cavity to allow concrete grout to flow around the bar so as to completely embed it. This is done by specifying a distance "d" from the outer surface of the block on the compression side of the wall to the center of the vertical steel bar. The larger the distance "d", the smaller the required steel area. If the actual "d" is smaller than the design "d", then the actual stress on the steel will be greater than the calculated stress, with the consequent potential for overstressing the steel.

In practice, it is difficult and, in fact, almost impossible to keep the vertical reinforcing bar at the precise distance "d" relative to the outer surface of the blocks from the top of the wall to its bottom as the grout is being poured. As a result, the bar may drift or bend away from the inner surface of the block toward the neutral axis of the wall, where the bar is subject to being overstressed. To compensate for uncertainty as to the actual distance "d", design engineers customarily use only 50% of the tensile strength of the steel in their calculations if there is not to be continual inspection of the steel on the job. This results in the use of oversize steel bars. Even when oversize steel reinforcing bars are specified, there is some danger that the bars may become displaced far enough from their design location to make them relatively ineffective, resulting in overstress in the masonry. Specifying oversize reinforcing bars is expensive, and adds greatly to the cost of the wall.

SUMMARY OF THE INVENTION

The primary object of the present invention is to provide means for positively locating vertical reinforcing bars at the precise position called for in the specification, thereby assuring the design engineer that the bar will remain at its intended location at all times, and its full tensile strength will be utilized. This object is achieved by means of continuous, ladder-like assemblies that are placed in the horizontal mortar joints of the wall at specified levels as the wall is built, the said assembly being formed of two laterally spaced steel wires that are joined together at intervals by transverse wires, having downwardly projecting locator pins that engage the blocks to position the assembly in the desired location, while certain of the transverse wires have circular rings formed therein, through which the vertical reinforcing bars are passed.

Among the advantageous features of this arrangement are: (1) it is easy to use, and saves time and money; (2) no special skill is required. The ladder is merely placed on the mortar joint, and locator pins position the ladder in the correct position; (3) the vertical reinforcing bars are fixedly held in the desired location and cannot move either longitudinally or transversely with respect to the wall; (4) the added steel of the ladder reduces the amount of steel reinforcement required; and (5) it allows the design engineer to use the full allowable stress for the steel reinforcement bar, as he can be confident that the bars will remain at the exact position specified and will not drift to a position where they would be subject to overstressing.

In another aspect of the invention, a similar means is utilized to locate the vertical reinforcing bars at precisely the locations specified by the design engineer for square columns built of concrete blocks or bricks, and filled with steel-reinforced grout. In this case, the vertical reinforcing bars are held precisely in their specified positions by means of square frames made of steel wire, having portions at the four corners that engage the corners formed by the blocks, so as to center the frame in the cavity formed by the blocks. The square frame has circular rings through which the vertical bars are passed, and these rings securely hold the bars in place while the grout is being poured. Here again, the advantage is that the vertical bars are positively held at the locations specified by the design engineer, where the full tensile strength of the steel is utilized.

The foregoing and other objects and advantages of the invention will become apparent to those skilled in the art from consideration of the following detailed description of the preferred embodiments thereof, together with the accompanying drawings.

BRIEF DESCRIPTION OF THE DRAWINGS:

FIG. 1 is a perspective view of a course of hollow concrete blocks, showing the device of the invention placed on a mortar joint, and with one vertical reinforcing bar inserted through a ring in the device;

FIG. 2 is an enlarged cross-sectional view taken at 2—2 in FIG. 1;

FIG. 3 is a fragmentary sectional view taken at 3—3 in FIG. 1;

FIG. 4 is a perspective view of a slightly different form of the invention setting on a mortar joint of a course of blocks, this embodiment being used where two vertical reinforcing bars are arranged side-by-side, as when the bottom courses of a wall are of extra wide blocks, while the upper courses are of normal width blocks;

FIG. 5 is a view showing an end view of a wall constructed as described above;

FIG. 6 is a perspective view of a short length of still another embodiment of the invention;

FIG. 7 is a perspective view of a square column formed of blocks, or bricks, showing another form of the invention; and FIG. 8 is a perspective view of still another form of the invention, for use in building a square column as shown in FIG. 7

DESCRIPTION OF THE PREFERRED EMBODIMENTS:

In FIGS. 1–3 of the drawings, the reference numeral 10 designates a portion of a block wall, made up of a plurality of conventional hollow concrete blocks 12, which are mortared together by end mortar joints 14 and horizontal mortar joints 16. In the drawings, the exposed top surface of the blocks is designated as a horizontal mortar joint, although no mortar has been applied as yet. Each of the blocks 12 has two side-by-side cavities 18 formed therein, which are separated by a transverse web 20.

The device of the present invention is designated in its entirety by the reference numeral 22, and is seen to be generally ladder-like in configuration, being made of two laterally spaced, parallel wires 24 and 26, which are joined together at intervals by transverse wires 28 and 30. The wire is preferably about No. 8 gauge steel wire, although other gauges may be used, depending upon the strength requirements. For a nominal 8-inch block, which is actually 7⅝ inches wide, wires 24, 26 would be spaced 6⅛ inches apart, so that the wires each lie ¾ inch in from the outer edge of the block, so that if the mortar joint is raked, the wires will not be exposed. In the case of a 12-inch block, which is actually 11⅝ inches wide, wires 24, 26 would be spaced 10⅛ inches apart. For blocks of other width dimensions, the wires 24, 26 would be spaced apart 1½ inches less than the actual width dimension.

Transverse wires 28 are formed with downwardly projecting legs 32 near each end thereof, which converge slightly, as best shown in FIG. 2. Legs 32 may be formed by bending the wire, as illustrated in the drawing, or by welding short lengths of wire to the cross-pieces 28. The purpose of the legs 32 is to center the ladder-like wire fixture 22 in the middle of the line of blocks 12, and to this end, the legs 32 are inserted down into the cavity 18, where they engage the inner side wall surfaces of the blocks. The downward taper, or convergance, of the legs 32 facilitates insertion of the legs down into the cavity, and when the device 22 is in place, the upper ends of the legs make contact with the cavity surface of the block, or lie very closely adjacent thereto, e.g. about ⅛-inch distance.

Closely adjacent one of the legs 32, the cross wire 28 is coiled into a circular ring 34 having an inside diameter of approximately ¾ inch, so that a ⅜, ½, or ⅝-inch steel reinforcing bar 36 can be passed down through the center of the ring. In some cases, as for free-standing walls, it may be desirable to have the vertical steel reinforcing bars 36 centered within the block cavity 18, in which case the ring 34 would be formed at the midpoint of the cross wires 28.

Cross wires 30 have no circular rings, but instead are provided with locaters 38, each consisting of a cross piece of wire 40 having a pair of downwardly turned legs 42 that straddle the center web 20 of the block, so as to fixedly locate the ladder-like fixture 22 lengthwise along the wall. Legs 42 also diverge downwardly to facilitate placing the legs down over the web 20.

The Uniform Building Code states that the vertical reinforcing bars 36 shall not be spaced more than 48 inches on center, but may be any lesser distance, such as 16, 24, 32 or 48 inches. Rings 34 may therefore be spaced apart along the length of the ladder-like fixture 22, various increments of distance which would make it possible to space the vertical bars at 16, 24, 32 or 48 inches on centers. Cross wires 30 with their locaters 38 would be spaced apart some multiple of the block length, so that the legs 42 will always be positioned to straddle the center web of a respective block.

One advantage of the invention is that the ladder-like fixture 22 can be turned 180° to place the vertical bars 36 near either the inner or outer surface of the wall. Thus, for a basement wall, the steel bars would be placed closer to the inside surface of the wall, whereas for a free-standing cantilevered retaining wall, the steel bars would be placed closer to the surface of the wall in contact with the soil.

The devices 22 are preferably formed in 8′6″ lengths, and are laid with their ends overlapping 3 inches so that when the overlapped ends are embedded in grout, the ladder devices 22 form, in effect, a continuous length of steel, which allows the wires 24, 26 to be figured as part of the horizontal steel reinforcing for the wall. Other horizontal steel reinforcement bars can therefore be correspondingly reduced in size. The devices 22 would be placed on the horizontal mortar joints at every 3rd or 4th course of blocks, according to the building code, with the rings 34 of each ladder aligned vertically with the rings of the ladders below. When the wall has been built to the desired height, vertical reinforcing bars 36 are inserted down through the rings 34, and the cavities containing the reinforcing bars are filled with grout.

The rings 34 of the ladder-like devices 22 hold the reinforcing bars 36 precisely at the designed locations, and prevent the bars from being displaced while the grout is being poured and puddled. With the vertical reinforcing bars positively located at the exact location specified by the design engineer, the full strength of the bars is utilized, and the strength of the wall is therefore assured. The rings 34 can be located wherever the design engineer specifies that the vertical bars 36 are to be placed, and, if desired two rings can be provided side-by-side on cross wire 28, as in FIG. 6, one of which is to receive the stub steel bar that is embedded in the concrete footing, and projects upwardly therefrom, while the other ring receives the vertical reinforcing bar that is lowered into the block cavity from the top of the wall. Alternatively, a single ring 34 might be provided at the midpoint of cross wires 28, or two side-by-side rings might be provided, as shown in FIG. 6. The rings 34 may be spaced apart longitudinally from one another by any desired distance to meet the engineer's design; or two rings can be provided on each cross wire 28, with one ring located adjacent each face of the block cavity, as when double steel is required for heavily loaded walls; and the rings can be made with any desired inside diameter to accept any particular size of reinforcing bar 36.

Masons who have tried the invention have found it easy to use, and approve of its use, as it saves them time and money in locating the vertical reinforcing bars according to specifications. The ladder-like fixture 22 is merely dropped into place on the mortar joint, and the legs 32 and 42 locate the device in the correct position. No special skill is required, and no time is wasted. The double-strength legs 32 are not easily bent out of shape, and are inclined inwardly approximately 15° from the vertical for ease of insertion.

A slightly modified form of the invention is shown in FIG. 4, where the ladder-like fixture is designated by the reference numeral 22′. This particular embodiment is intended for use in the situation where the bottom three or four courses of blocks are made with 12-inch blocks and the remainder with 8-inch blocks, as in FIG. 5. In this case, the bottom blocks are anchored to the concrete footing 35 by means of stub steel bars 36', the bottom ends of which are embedded in the concrete, and the top ends of which project upwardly from the surface of the footing for approximately the height of the bottom three or four courses. As the blocks are laid, they are lowered over the top ends of the stub steel bars 36'. The devices 22' that are used with the bottom three or four courses of wide blocks, and particularly at the junction of the narrower blocks with the wider blocks, are provided with a third longitudinal wire 44 which is disposed between and parallel to outer wires 24' and 26'. Wherever wire 44 crosses over the cross wires 28' and 30', it is welded to them to provide additional strength and rigidity to the ladder. Longitudinal wires 44 and 26' are spaced apart the same distance that wires 24 and 26 are spaced for the ladders used in the upper courses of blocks. Thus wire 44 is embedded in the transverse mortar joint between the top block of the wide blocks and the bottom block of the narrower blocks forming the upper portion of the wall. Cross wires 28' have two circular rings 34' formed therein, which are located to position vertical reinforcing bars 36 and 36' at the correct location, as shown in FIG. 5.

Cross wire 28' also has downwardly projecting legs 32' adjacent the outer wires 24', 26', and cross wire 30' has a cross piece 40' with downwardly projecting legs 42' at each end, which straddle the center web 20 of the block. As in the preceding embodiment, the legs 32' and 42' are set at a 15° angle to facilitate placement of the ladder on the blocks.

Another form of the invention is shown in FIG. 6, where the ladder-like fixture is designated by the reference numeral 22". In this case, the cross wire 28" have two rings 34" formed side-by-side, one of which receives a stub steel bar projecting upwardly from the concrete footing, and the other receiving a vertical reinforcing bar which is lowered into the block cavity from the top of the wall prior to being embedded in grout. Otherwise, the ladder fixture 22" is generally similar to fixture 22 in FIGS. 1-3.

FIG. 7 shows still another form of the invention, designed specifically to locate the vertical reinforcing bars in a square column 48 built up of column blocks 50. The blocks 50 are laid up, one on top of the other, forming a square cavity 52 in the center of the column. The fixture 46 is formed of wire 54 bent into a square configuration, with horizontally outwardly projecting legs 56 at the midpoints of the four sides of the square. Welded to the wire 54 on the insides of the four corners are four circular rings 58. Also welded to the wire 54 at the four corners thereof are downwardly projecting legs 60, which extend down into the cavity 52 to center the fixture 46 on the column. Rings 58 may be located anywhere along the length of the wire 54, as specified by the design engineer, and when the vertical steel reinforcing bars have been passed down through the rings, the bars will be positively held in the exact position specified.

Still another form of the invention is shown in FIG. 8, where the fixture is designated by the reference numeral 62. Fixture 62 is also designed for use in a square column of the type shown in FIG. 7. Fixture 62 also comprises a wire 64 bent into a square, with circular rings 66 welded to the insides of the four corners, and upwardly projecting legs 68 also welded to the corners. At their upper ends, the legs are bent horizontally outward at 70 to form fingers that rest on the top edges of the blocks. The square wire fixture 64 is dropped into the cavity of the column, and legs 68 fit snugly into the corners of the cavity to center the fixture within the cavity. As in the preceding embodiments, rings 66 may be welded at any desired location along the length of the wire 64 to position the vertical bars at the exact location specified by the engineer.

While I have shown and described in considerable detail what I believe to be the preferred embodiments of the invention, it will be understood by those skilled in the art that the invention is not limited to such details, but may take various other forms within the scope of the claims.

What I claim is:

1. A fixture for use in masonary construction utilizing hollow blocks having two longitudinally spaced cavities separated by a transverse web, wherein vertical reinforcing bars must be precisely located within a cavity that is subsequently filled with cement grout, said fixture comprising:

a horizontal supporting structure that is adapted to be placed on the top surfaces of the blocks at various levels of the masonry construction as the blocks are being laid, said supporting structure consisting of a ladder-like unit formed with laterally spaced, parallel wires that are connected together at intervals by cross-wires;

said horizontal supporting structure having a plurality of rings provided thereon at locations where the reinforcing bars are to be located, said rings of the supporting structures at different levels of the masonry construction being vertically aligned with respect to one another so as to receive the vertical reinforcing bars when the latter are passed downwardly into the cavity and through the rings from the top of the completed or partially completed construction; and certain of said cross wires having cross pieces attached thereto, said cross pieces terminating in downwardly bent legs that are adapted to straddle the transverse webs of the blocks.

2. A fixture as in claim 1, wherein said rings are provided on others of said cross wires.

3. A fixture as in claim 2, wherein said other cross wires are also provided with downwardly projecting legs that are adapted to engage the inner side surfaces of the block cavities so as to locate said rings a precise distance inwardly from the inner side surfaces of the cavities.

4. A fixture for use in masonry construction utilizing hollow blocks which, in the completed construction, form a generally square cavity, and in which vertical reinforcing bars must be precisely located within the cavity that is subsequently filled with cement grout, said fixture comprising:

a horizontal supporting structure that is adapted to be placed on the top surfaces of the blocks at various levels of the masonry construction as the blocks are being laid, said supporting structure comprising wire bent into a square;

a plurality of rings attached to the inside of the four corners of the square, said rings of the supporting structure at different levels of the masonry construction being vertically aligned with respect to one another so as to receive the vertical reinforcing rods when the latter are passed downwardly into the cavity and through the rings from the top of the completed or partially completed construction; and legs at the corners of the square that are adapted to engage the inside corners of the square cavity to center the supporting structure within the cavity.

* * * * *